US005185557A

United States Patent [19]

Luijks et al.

[11] Patent Number: 5,185,557

[45] Date of Patent: Feb. 9, 1993

[54] HIGH-PRESSURE DISCHARGE LAMP

[75] Inventors: Gerardus M. J. F. Luijks; Hubertus A. M. Coenen, both of Eindhoven, Netherlands

[73] Assignee: U.S. Philips Corporation, New York, N.Y.

[21] Appl. No.: 823,927

[22] Filed: Jan. 22, 1992

[30] Foreign Application Priority Data

Jun. 12, 1991 [EP] European Pat. Off. ..... 91201437.0

[51] Int. Cl.[5] ..... H05B 41/04

[52] U.S. Cl. ..... 315/59; 315/53; 315/73; 315/290

[58] Field of Search ..... 315/46, 47, 51, 52, 315/53, 58, 59, 60, 73, 290, DIG. 7

[56] References Cited

U.S. PATENT DOCUMENTS 4,520,294 5/1985 Iida et al. ..... 315/290 X

*Primary Examiner*—David Mis

*Attorney, Agent, or Firm*—Brian J. Wieghaus

[57] ABSTRACT

A high-pressure discharge lamp has an outer bulb which surrounds a discharge vessel with intervening space. The lamp is provided with an ignition circuit which comprises a SIDAC. According to the invention, the SIDAC is mounted in a gas-filled, hermetically closed glass capsule in the outer bulb.

5 Claims, 1 Drawing Sheet

HIGH-PRESSURE DISCHARGE LAMP

BACKGROUND OF THE INVENTION

1. Field of the Invention

The invention relates to high-pressure discharge lamp provided with a discharge vessel, which vessel is enclosed with intervening space by an outer bulb and fitted with a lamp cap, and provided with an ignition circuit comprising a SIDAC.

2. Description of the Prior Art

A lamp of the kind mentioned in the opening paragraph is known from U.S. Pat. No. 4,520,294. In the known lamp, which is suitable for operation in series with a stabilizer ballast on an AC voltage supply source, the SIDAC is positioned in the outer bulb and provided with a glass envelope as a protection against reduction and evaporation of parts of the SIDAC. Practice has shown, however, that this involves major disadvantages. On the one hand, the manufacture of a SIDAC provided with such an envelope is very difficult, which renders the SIDAC very expensive. On the other hand, the known lamp is found to show a high percentage of early failures owing to blackening of the discharge vessel.

It is attractive, however, to position the ignition circuit including the SIDAC in the outer bulb because of a comparatively simple lamp manufacturing method, one of the reasons being the availability of comparatively much space in contrast to, for example, the lamp cap. In addition, when the ignition circuit is positioned in the outer bulb, only two electric conductors need be guided from the discharge vessel to the lamp cap through this outer bulb. This means a considerable manufacturing advantage compared with constructions in which only a portion of the starting circuit is included in the outer bulb.

SUMMARY OF THE INVENTION

The invention has for its object to provide a measure by which the described disadvantages are counteracted, while a comparatively simple lamp manufacturing method is maintained.

According to the invention, this object is realized in a lamp of the kind mentioned in the opening paragraph in that the lamp is characterized in that the SIDAC is mounted in a gas-filled space in the outer bulb. The gas-filled space may be the entire space enclosed between the outer bulb and the discharge vessel. To be preferred, however, is a construction whereby the SIDAC is accommodated in a hermetically closed capsule. The advantage is that the heat balance between the discharge vessel and the outer bulb is not affected in the case of a hermetically closed capsule. A glass capsule is preferably used as the hermetically closed capsule.

An advantage is that the SIDAC is accommodated in a glass capsule by means of a technique which has long been known and proved effective, so that production is simple and reliable, leading to cost reduction in comparison with the known lamp. The pressure of the gas then ensures that dissociation and/or evaporation of components from which the SIDAC is built up is counteracted. Gas composition is so chosen that no reactions with components of the SIDAC take place under the prevalent conditions during lamp operation. Suitable gases are rare gases, nitrogen and oxygen, and $SF_6$. The gas filling may be formed by a single gas, but combinations of gases are also possible.

As was stated above, it is conceivable to fill the outer bulb itself with a suitable gas instead of using a separate capsule. An equivalent protection against dissociation and/or evaporation of the SIDAC may be achieved by this. Heating of the SIDAC may also be considerably reduced as a result of convection and conduction in the gas present in the outer bulb. The said convection and conduction lead to thermal losses, and thus affect the luminous efficacy of the lamp. Therefore, this is a less suitable solution for a large number of high-pressure discharge lamp types. However on the other hand the increased convection and conduction give a greater freedom in lamp design, making it possible to design within the same dimensions a lamp with an increased nominal power and corresponding increased luminous flux, whether a lamp with equal norminal power and luminous flux having smaller dimensions.

A further advantage of the invention is that the use of the hermetically closed, gas-filled capsule for mounting the SIDAC means that the measure according to the invention is generally applicable in high-pressure discharge lamps.

A further improvement of the lamp can be achieved in that the capsule is provided with a radiation-reflecting layer. It is achieved in a simple but effective manner by this that heating of the SIDAC in the operational state of the lamp is considerably reduced. The radiation-reflecting layer may be provided either externally or internally. If the ignition circuit also includes a voltage-dependent capacitor, this capacitor is preferably mounted together with the SIDAC in the capsule. Preferably, the voltage-dependent capacitor is so positioned that the longitudinal axis of the discharge vessel lies substantially in a common plane with the capacitor, which is usually disc-shaped. Irradiation of the capacitor is minimized by this.

The use of a SIDAC in combination with a voltage-dependent capacitor render the generation of very high voltage pulses possible. In an ignition circuit thus constructed, it is preferable for the hermetically closed capsule to be filled with $SF_6$ at a pressure of at least 0.5 atmosphere.

A further improvement is possible in that the ignition circuit is also provided with a fuse. It is achieved by this that even under unfavorable conditions, such as short-circuiting of the capacitor, an overload of the stabilizer ballast through excessive currents is prevented by melting of the fuse. The fuse may be included in the capsule.

BRIEF DESCRIPTION OF THE DRAWINGS

The invention will be explained in more detail with reference to a drawing of an embodiment in which.

DESCRIPTION OF THE PREFERRED EMBODIMENT

Figure 1:
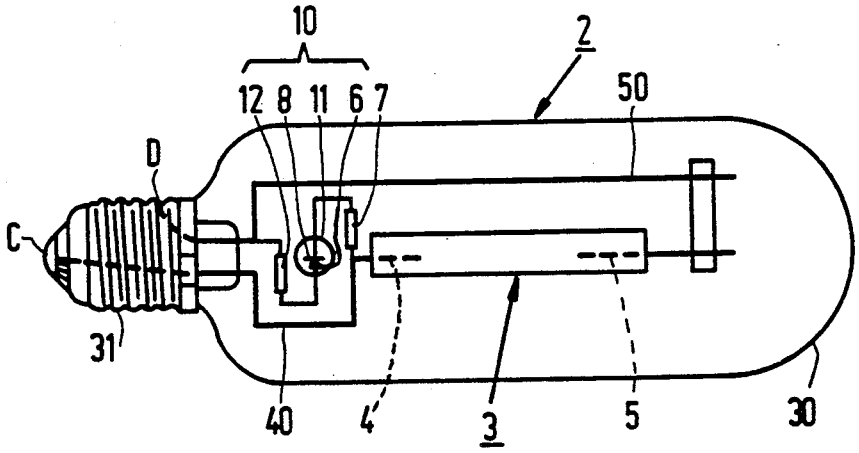
FIG. 1 is an elevation of a lamp.

FIG. 1 shows a lamps 2 according to the invention provided with a discharge vessel 3, which is enclosed with intervening space by an outer bulb 30 fitted with a lamp cap 31, and provided with an ignition circuit 10 comprising a SIDAC 6. The SIDAC 6 is mounted in a hermetically closed, gas filled glass capsule 11. The discharge vessel 3 is provided with lamp electrodes 4 and 5 between which a discharge takes place in the operational state of the lamp. Lamp electrode 4 is connected to a lamp connection point C of lamp cap 31 via a rigid current conductor 40. Similarly, lamp electrode 5 is connected to a lamp connection point D of lamp cap 31 via a rigid current conductor 50.

The starting circuit 10 is also provided with a fuse 7 and a voltage-dependent capacitor 8. The voltage-dependent capacitor 8 in this case is mounted in the capsule 11 together with the SIDAC 6.

Figure 2:
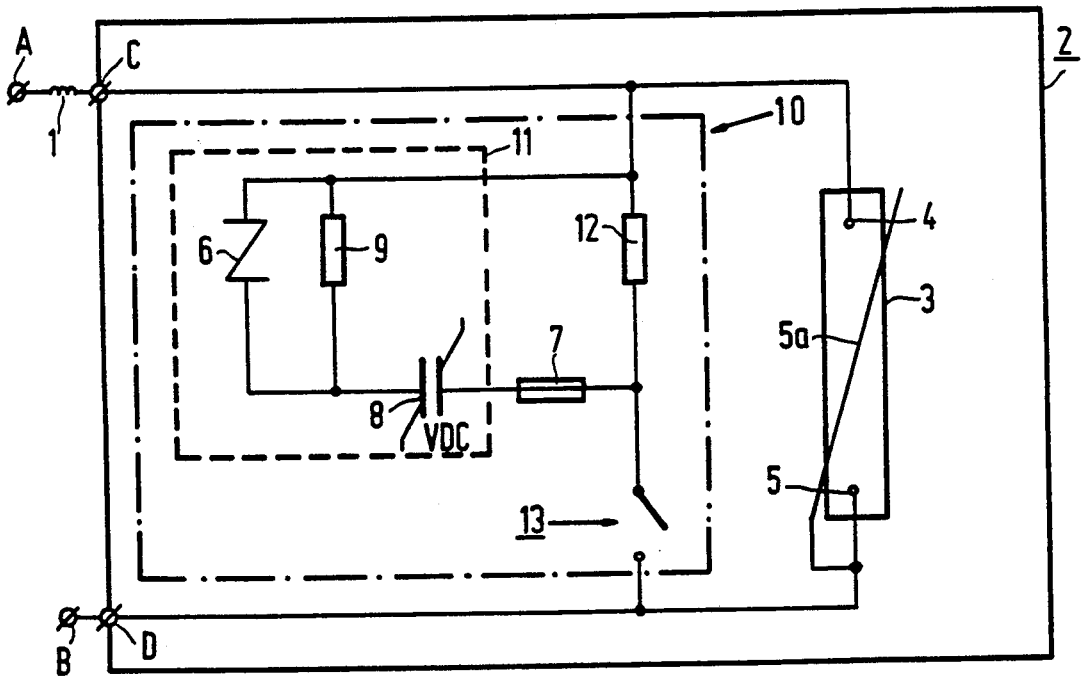
FIG. 2 is a diagram of a circuit formed by the lamp of FIG. 1 together with a stabilizer ballast.

In the FIG. 2, parts corresponding to those in FIG. 1 are given the same reference numerals. A and B are connection points for connecting an AC voltage supply source. Connection point A is connected to lamp connection point C via a stabilizer ballast 1. Connection point B is connected to lamp connection point D. The ignition circuit 10 formed by the chain comprising SIDAC 6, fuse 7, voltage-dependent capacitor 8, resistors 9 and 12, and a bimetal switch 13 in conjunction with stabilizer ballast 1 generates in known manner ignition pulses between the lamp connection points C and D, and thus between the lamp electrodes 4 and 5.

The discharge vessel 3 may be provide with an external auxiliary electrode 5*a* as a further ignition aid.

The bimetal switch 13 is closed in the non-ignited state of the lamp and is open in the operational state of the lamp owing to the heat generation in this operational state. In a possible embodiment, the bimetal switch is so constructed that it also ensures that the electrical contact between auxiliary electrode 5*a* and lamp electrode 5 is broken in the operational state of the lamp. A further option is that the auxiliary electrode 5*a* is substantially bent away from the discharge vessel 3 in the open state of the bimetal switch 13 owing to the action of this bimetal switch.

The resistors 9 and 12 serve to ensure that the voltage-dependent capacitor can always discharge, also in the case of an open bimetal switch 13.

The resistor 9 serves to increase the reproducibility of the moment an ignition pulse is generated in relation to the instantaneous value of the supply voltage.

In a practical embodiment of a lamp according to the invention, the lamp was a high-pressure sodium discharge lamp with a power rating of 150 W. The discharge vessel contained xenon with a pressure of 27 kPa at 300 K in addition to sodium and mercury. The lamp was operated on a supply voltage source of 120 V, 60 Hz through a mercury—CWA 175 W—stabilizer ballast, type 71A3002, make Advance Transformer. The discharge vessel was provided with an external auxiliary electrode.

The ignition circuit was formed by a type K1-V-15I SIDAC, make Shindengen, which was mounted in a gas-filled gastight glass capsule together with a voltage-dependent capacitor, make TDK. The disc-shaped capacitor was at a distance of approximately 20 mm from the adjacent end of the discharge vessel and was substantially in one common plane with the longitudinal axis of the discharge vessel. The gas filling was formed by $SF_6$ which had a pressure of 0.5 at room temperature.

Upon connection to the 120 V, 60 Hz supply source, the ignition circuit generated an ignition voltage pulse of approximately 2.5 kV approximately 1 ms after each zero passage of the supply voltage. The lamp ignited quickly and reliably on this. The lamp was thus found to be suitable for operation in a usual installation for a high-pressure mercury lamp, and thus to serve as a replacement for a 175 W high-pressure mercury lamp.

We claim:

1. A high-pressure discharge lamp provided with a discharge vessel, which vessel is enclosed with intervening space by an outer bulb and fitted with a lamp cap, and provided with an ignition circuit comprising a SIDAC, characterized in that the SIDAC is mounted in a gas-filled space in the outer bulb.

2. A lamp as claimed in claim 1, characterized in that the SIDAC is mounted in a gas-filled, hermetically closed capsule.

3. A lamp as claimed in claim 2, characterized in that the capsule includes a radiation-reflecting layer.

4. A lamp as claimed in claim 3, characterized in that the ignition system also comprises a voltage-dependent capacitor which is mounted in the capsule together with the SIDAC.

5. A lamp as claimed in claim 2, characterized in that the ignition system also compromises a voltage-dependent capacitor which is mounted in the capsule together with the SIDAC.

* * * * *